252-95 AU 166 EX
1/13/81 XR 4,244,832

United States Patent [19]
Kaneko

[11] 4,244,832
[45] Jan. 13, 1981

[54] PHOSPHATE-FREE MACHINE DISHWASHING DETERGENTS USEFUL AT LOW TEMPERATURES

[75] Inventor: Thomas M. Kaneko, Trenton, Mich.

[73] Assignee: BASF Wyandotte Corporation, Wyandotte, Mich.

[21] Appl. No.: 61,119

[22] Filed: Jul. 27, 1979

[51] Int. Cl.[3] ..... C11D 7/28; C11D 7/54
[52] U.S. Cl. ..... 252/99; 252/95; 252/174.14; 252/174.21; 252/174.22; 252/156; 252/525
[58] Field of Search ..... 252/99, 95, 174.14, 252/174.21, 174.22.525, 156

[56] References Cited

U.S. PATENT DOCUMENTS

| | | | |
|---|---|---|---|
| 2,979,528 | 4/1961 | Lunster | 252/110 X |
| 3,359,207 | 12/1967 | Kaneko et al. | 252/99 |
| 3,888,781 | 6/1975 | Kingry et al. | 252/99 |
| 4,001,133 | 1/1977 | Sorgenfrei et al. | 252/156 |
| 4,062,814 | 12/1977 | Hansen | 252/156 X |
| 4,123,375 | 10/1978 | Atensenopfer et al. | 252/99 |

*Primary Examiner*—Mayer Weinblatt
*Attorney, Agent, or Firm*—Andrew E. Pierce; John W. Linkhauer

[57] ABSTRACT

It is possible to provide a detergent for use in dishwashing machines which is both completely free of phosphate and is useful at temperatures such as 120° F. (49° C.), by making a mixture containing 30 percent sodium citrate, 20 percent sodium carbonate, 1–6 percent of chlorinated cyanurate, 20–40 percent of sodium metasilicate, 1 to 9 percent of nonionic surfactant of a kind disclosed herein; and the remainder of fillers, such as sodium sulfate and/or sodium chloride.

13 Claims, No Drawings

PHOSPHATE-FREE MACHINE DISHWASHING DETERGENTS USEFUL AT LOW TEMPERATURES

BACKGROUND OF THE INVENTION

1. Field of the Invention

This invention relates to compositions of matter useful for machine washing of dishes, glassware, and the like, and it also relates to methods of washing which utilize a composition of the kind hereinafter described for washing with water not highly heated.

2. Description of the Prior Art

U.S. Pat. No. 3,812,045, issued May 21, 1974, accurately teaches: "Detergent compositions for use in automatic dishwashers must meet a number of criteria such as protection of overglaze decoration of china, non-spotting of glassware, non-tarnishing of silverware, detergency for cleaning the items being washed, absence of filming, non-caking of composition on the shelf, non-gelling of the composition in the washing machine, retention of available chlorine during shelf life for subsequently sanitizing items in the washer and others. All too frequently the solution to one problem results in the recurrence of one of the other difficulties."

It may be taken as a part of the prior art that there has been used, as taught in volume 19 of the *Chemical Formulary* by Bennett, a formulaton consisting of, by weight, 3 percent of "Pluronic 24R2" nonionic surfactant made by BASF Wyandotte Corporation, 35 percent of tetrasodium pyrophosphate, 20 percent of sodium polyphosphate, 10 percent of sodium metasilicate pentahydrate, 2 percent of chlorinated cyanurate, 18 percent sodium carbonate, and 12 percent water. In general, except for some possible changes in respect to the identity and proportion of the nonionic surfactant used, and the inclusion in the surfactant of a minor proportion of monostearyl acid phosphate as a defoaming agent as taught in U.S. Pat. No. 3,314,891, such detergents have been the best ones currently commercially available, but they are not phosphatefree.

U.S. Pat. No. 3,899,436 discusses the problem of obtaining a machine-dishwashing detergent of low phosphate content, indicating that much, but not all, of the phosphates should be replaced with sodium citrate or with citric acid, assuming that enough of alkali-metal hydroxide is present to neutralize the acid.

Moreover, the prior art does not, for the most part, concern the additional problem of finding a dishwashing detergent that will work properly when the wash water is relatively cooler than what has been used before. Ever since the remarkable increase in the price of oil in 1973, it has been evident that it would be desirable to have a detergent which performs adequately in cooler water, but it has been clear to those skilled in the art that it would be difficult to find a composition that would perform satisfactorily at lower wash-water temperatures, both because higher temperatures make the oils and fats on the dishware or glassware to be cleaned less viscous and more removable and because the nonionic surfactants used in dishwasher-detergent compositions, like other non-ionic surfactants, generally give greater amounts of foam with lower water temperatures.

It is known, moreover, that the problem with foam in the use of a dishwasher detergent is made particularly more difficult because of the tendency, unless something is done, for the nonionic surfactant to react with proteinaceous material, such as egg soil, to yield especially large proportions of foam—foam of a kind which is particularly difficult to reduce or disperse. U.S. Pat. No. 3,314,891 teaches the idea of including 0.1 to 50 weight percent of stearyl acid phosphate or oleyl acid phosphate, together with 50 to 99.9 weight percent of nonionic surfactant, as the nonionic-surfactant component in the dishwashing-detergent composition, as a way of overcoming the problem of foaming caused by egg soil, but this patent obviously provides no answer to those skilled in the art if a phosphate-free detergent is required.

The general idea of producing a nonionic surfactant by starting with a material having a plurality of active hydrogen compounds and then reacting it, first with ethylene oxide, to produce a plurality of oxyethylene units on the sites of the active-hydrogen compound, and then reacting the material so obtained further with propylene oxide, to produce polyoxypropylene capping chains which are connected to the oxyethylene chains, is disclosed in U.S. Pat. No. 3,036,118. U.S. Pat. No. 2,979,528 discloses similar nitrogen-containing surfactants or detergents, but ones in which the oxypropylene units are added first and the oxyethylene units form a cap. Neither of the above-mentioned patents indicates, however, the possibility that with a tetrafunctional nitrogen-based nonionic surfactant meeting the specifications indicated hereinbelow, with interior oxyethylene blocks and exterior caps of oxypropylene units, it would be possible, in the dishwasher-detergent art, to obtain a detergent which is not only phosphate-free but also effective, even against long-hardened partially cooked egg soil, when the wash water is at a low temperature, such as 100° F. (about 38° C.) or even lower.

In the art of formulating dishwasher-detergent compositions, it has been usual to make a distinction between compositions intended for home use—ones containing 0 to 3 percent of nonionic surfactant—and ones intended for institutional or commercial use—ones containing 2 to 6 percent of nonionic surfactant. The former ones are usually less alkaline, and they are intended to use in machines having a cycle on the order of 40 to 60 minutes, and the latter ones are compositions which are relatively more alkaline and are intended for use in machines which have a shorter cycle, one on the order of 15 to 20 minutes.

With the nonionic surfactants which have been commercially available, it has usually been impossible to obtain satisfactory dishwashing performance if the composition or formulation contains anything more than about 5 or 8 percent of "filler material", such as sodium chloride or sodium sulfate; usually, it has been necessary, in order to obtain satisfactory performance, to omit such materials altogether. To obtain satisfactory performance from a composition containing over 10 weight percent of filler material is, in view of the prior art as explained above, a surprising result.

The usual tests to which a dishwasher-detergent composition can be subjected may be taken as belonging to the prior art.

The formost among such tests is an egg-soil detergency test. Dinnerware is soiled with partially cooked egg, and permitted to stand for a certain period of time in air, and then washed in a dishwasher, usually using a washing liquid containing 0.3. weight percent of detergent and usually using conditions such as a wash at 150°

F. and a rinse at 180° F., although in the case of efforts to develop a detergent effective at lower temperatures, other wash/rinse temperature conditions are used, such as 140/140 or 120/120. The number of minutes that such egg soil is permitted to stand, before dishwashing begins, has a distinct effect upon the percentage of removal of egg soil that is observed. Although many commercially available detergents perform very satisfactorily on such egg soil which has stood for only 10 minutes or less, especially when hot water (wash/rinse at 150/180) is used, the results with a standing time of as long as 17 minutes or 27 minutes are usually notably less satisfactory (5, 10, 20 percent not clean).

Another test commonly performed is a chlorine stability test. It is common to expect a detergent to have a shelf life of 3 or 4 months, and it is important that its active-chlorine content not decrease by too much over that length of time. A common accelerated test is to store the material for one month at 50° C., determining the available chlorine before and after. The results are generally considered equivalent to those obtained with 4 months of storage at room temperature.

It can be taken as known that, in respect to protection of the overglaze decoration on china, the nonionic surfactant which is used has little effect; the principal effect comes from the combination of alkali-metal salts or other compounds (sodium carbonate, sodium silicate, sodium hydroxide, etc.) which are used.

BRIEF SUMMARY OF THE INVENTION

It is possible to provide a detergent for use in dishwashing machines which is both completely free of phosphate and is useful at temperatures such as 120° F. (49° C.) by making a mixture containing 30 percent sodium citrate, 20 percent sodium carbonate, 1-6 percent of chlorinated cyanurate, 20-40 percent of sodium metasilicate, 1 to 9 percent, preferably 1 to 6 percent, of nonionic surfactant of a kind disclosed herein, and the remainder of fillers, such as sodium sulfate and/or sodium chloride.

DESCRIPTION OF THE PREFERRED EMBODIMENTS

As a dishwasher detergent, there may be made a composition as follows, percentages being by weight: sodium citrate, 30 percent; sodium carbonate, 20 percent; sodium metasilicate pentahydrate, 30 percent; chlorinated cyanurate such as potassium dichloroisocyanurate, 3 percent; nonionic surfactant based uppon N,N,N',N'-tetrakis (2-hydroxypropyl)ethylenediamine as defined below, 6 percent; and filler selected from the group consisting of sodium sulfate and sodium chloride, 11 percent.

Satisfactory results may be obtained by using such composition in a dishwashing machine under conditions that the wash liquid contains 0.3 weight percent of the composition indicated above, and with the use of a washwater temperature which preferably is less than 160° F. (71° C.) and may be as low as 100° F. (38° C.).

The definitions given above are incomplete, unless it is specified that the nonionic surfactant is one which is based upon N,N,N',N'-tetrakis(2-hydroxypropyl)ethylenediamine which has first been reacted with ethylene oxide, and then later with propylene oxide, to produce a block copolymer in which the nominal molecular weight which is attributable to the oxypropylene hydrophobe portion of the molecule is on the order of 800 to 2000 per chain and in which the proportion of the molecular weight of the molecule which is attributable to oxyethylene units is low, being on the order of 5 to 16 percent. Two particular grades of such nonionic surfactant based upon the above-named tetrafunctional polyol, first oxyethylated and then oxypropylated, have been made and are sold by the applicants' assignee as "Tetronic 90R1" and "Tetronic 150R1" surfactants. The former has a nominal molecular weight attributable to the oxypropylene hydrophobe cap of 900 per chain and a nominal proportion of the molecular weight attributable to oxyethylene units of 15 percent. The latter is similar, but with an average molecular weight attributable to the oxypropylene hydrophobe cap of 1500 per chain.

To define in other terms the structure of the nonionic surfactant used in accordance with the present invention, there is used a compound of the formula

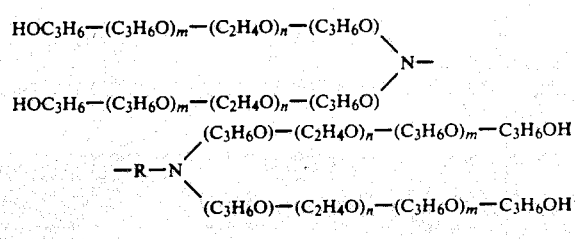

wherein n and m have values such that the portion of the total molecular weight which is attributable to the oxypropylene hydrophobe cap is 800 to 2000 per chain and the portion of the total molecular weight which is attributable to the oxyethylene units is 5 to 16 percent, and R is a divalent organic radical containing 2 to 6 carbon atoms, preferably an alkylene radical containing 2 to 6 carbon atoms. In a preferred embodiment, R is ethylene. Such compounds can be made, in some instances by starting with a tetrafunctional polyol which is made, as taught in expired U.S. Pat. No. 2,697,118, by reacting ethylene diamine or some other suitable alkylene diamine containing 2 to 6 carbon atoms with 4 moles of propylene oxide, and then first oxyethylating and finally oxypropylating to product the desired block polymer.

Those skilled in the art of nonionic surfactants will appreciate that these compounds are rather similar to the known "Tetronic" polyols marketed by BASF Wyandotte Corporation, which are compounds having the structure

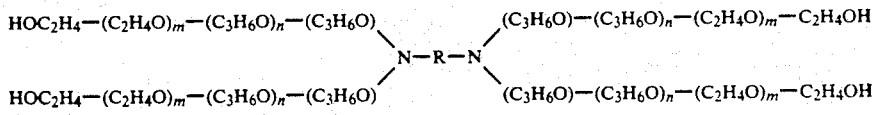

Such compounds are the subject of U.S. Pat. No. 2,979,528. That is, the known commercial polyols of this kind are also block polymers which start with the same tetrafunctional polyol, but the oxypropylene units are inside, and the oxyethylene units form the "caps" or the ends of the chains. This difference might not seem to be important, but it is the truth that these compounds simply do not have the same performance in machine dishwashing. It can be admitted that elsewhere in the field of nonionic surfactants which are block polymers containing oxyethylene and oxypropylene units, it is known that the ones where the oxypropylene units form the caps or ends of the chains are, other things being equal, lower-foaming, but it has not been evident to those skilled in the art of formulating dishwasher detergents that these alkylene-diamine-based oxypropylene-capped surfactants would ever be as good as they are. They make it possible not merely to avoid some of the foaming, as one might expect; they go further, making it possible to remove 27-minute-hardened partially cooked egg soil with a wash-water temperature of only 120° F. (49° C.), and the other thing that they do which is quite unexpected is that they make it possible to avoid the use of MSAP (monostearyl acid phosphate) or some other similar phosphate-containing agent for use is suppressing the particular kind of foaming that results from trying to wash dishes that are soiled with egg or equivalent proteinaceous matter.

U.S. Pat. No. 3,036,118 concerns surfactants in the nature of block polymers wherein there are internal segments of oxyethylene units and there also are external oxypropylene units. Though U.S. Pat. No. 2,979,528 teaches that nonionic surfactants based on ethylenediamine are superior to ones based on polyalkylene glycol, because they are better detergents at low temperatures, and though U.S. Pat. No. 3,036,118 says that the block polymers with external oxypropylene groups have relatively lower cloud points and foam heights, in comparison to the results with block polymers with internal oxypropylene and external oxyethylene groups, this nevertheless does not give anyone skilled in the art any reason to expect that the advantages of using an amine-based tetrafunctional block polymer with internal oxyethylene and external oxypropylene groups would be as great as they are. The prior art does not suggest the existence of any utterly phosphate-free dishwasher detergent which performs satisfactorily even at 120° F. (49° C.) and working against long-hardened soil of partially cooked egg.

In general, the object has been to produce a dishwasher detergent that can be used at the usual level of 0.3 weight percent in the wash liquid. Those skilled in the art will appreciate that if the proportion of detergent, in comparison to that of water which is to be used, is increased or decreased, this will have a considerable effect on the performance and the proper proportions of active ingredients. At the present state of the art, it is hardly possible to expect to get adequate results with less than about 0.2 percent of detergent composition. There is no economic advantage to the use of any more of detergent composition than is necessary, considering all the conditions, including the wash-water temperature. Thus, it is hardly likely that anyone would use more than 0.5 percent of dishwasher-detergent composition in any event.

The dishwasher detergents of the invention are useful, even when the wash water is relatively hot, such as 180° F. (82° C.), but the particular usefulness of detergent compositions in accordance with the present invention does not become especially apparent unless the wash water is relatively cool, such as 120° F. (49° C.). If one assumes that the washwater temperature to be used is something which can easily be adjusted, then it is clear that one would, other things being equal, use a higher temperature if the dishes to be washed contain 27-minute egg soil than if they had 10-minute egg soil at the worst. A principal point in connection with the invention is that, whatever the wash-water temperature, other things being equal, a dishwasher detergent which contains a given and appropriate proportion of a nonionic surfactant as defined above is quite likely to be able to outperform one that uses an equal quantity of one of the hitherto known surfactants. Moreover, there is a trade-off between performance and wash-water temperature, and this means that in some instances, wash-water temperatures lower than what is usual (considering the task at hand) can be used.

As recited above, a typical composition in accordance with the invention is one which contains, in addition to its proportion of proper surfactant, 30 weight percent of sodium citrate. The figure of 30 percent is not absolute; it might be anything in the range of 22 to 38 percent, or 25 to 35 percent. Moreover, so far as the results obtained are concerned, omitting any consideration of cost, the corresponding equimolar quantities of other alkali-metal salts can reliably be expected to be just as effective. Sodium citrate is relatively available and inexpensive, and it is preferred. Those skilled in the art realize that the citrate ion has a kind of sequestering action, and they therefore know that it will in some circumstances be possible to replace the citrate in whole or in part by some other sequestrant, such as an alkali-metal gluconate or ethylenediaminetetraacetate or the like.

The preferred composition contains 20 weight percent of sodium carbonate, but those skilled in the art know that the carbonate content may be varied, for example, between 15 and 25 percent by weight and other equivalent alkali-metal or ammonium or soluble alkaline-earth-metal salts may be used in equal molar proportions. If there is no requirement that a phosphate-free detergent be produced, any of the various sodium or potassium phosphates could be used just as well—that is, assuming that the only problem to be solved is the removal of hardened egg soil without the use of the usual high-temperature wash water. Although when the wash water is at 160° F. (71° C.) or 180° F. (82° C.), all sorts of dishwasher-detergent compositions will yield results, it is quite another thing if the requirement is that satisfactory detergency and satisfactory results in respect to various other factors mentioned above are to be obtained although the wash water is relatively cool.

Chlorinated cyanurate contains active chlorine and acts as a bleach. A preferred composition contains 4 percent by weight, with 1 to 6 percent as a range. Again, those skilled in the art can think of substitutes and the ranges in which they might be used to obtain an equivalent active-chlorine content and effect. Sodium hypochlorite plus either sodium carbonate or sodium silicate may be useful. Dichlorodimethylhydantoin may also be useful.

Sodium metasilicate serves, perhaps among other things, to retard the attack of the detergent upon metals, among which iron and aluminum may be mentioned. A preferred composition contains 30 percent of sodium metasilicate pentahydrate, with 20 to 40 percent as a range, but those skilled in the art will know how this can be changed or varied. The sodium silicate also serves as a builder of the detergent composition. Other alkali-metal silicates can be expected to have a similar effect, but for the most part, they are more costly and have no economic advantage.

There is no requirement that the dishwasher-detergent composition contain any filler, at least so far as obtaining the desired effect is concerned. A filler such as sodium chloride or sodium sulfate is relatively inert. What is surprising to someone skilled in the art of formulating dishwasher-detergent compositions is that it would be possible to use any filler at all, especially when the problem to be solved is that of removing hardened partially cooked egg soil with cool washwater. Most of the time heretofore, even with warm washwater, it has been difficult or impossible to remove hardened egg soil if the detergent contains any filler at all, because of the relative inferiority of the nonionic surfactant employed. In accordance with one preferred manner of practicing the invention, however, it is possible to use a substantial proportion of filler material, from 2 percent up to approximately 15 percent by weight of the detergent composition. The proportion of filler which can be tolerated obviously depends on a variety of factors, such as the nature and quantity of soil on the dishware to be washed, the temperature of the wash water, the proportion of detergent used, the nature and relative quantity of the surfactant employed, etc.

Although in the foregoing disclosure, reference has repeatedly been made to salts of sodium, those skilled in the art will appreciate that such sodium salts may be replaced, partly or in toto, by corresponding salts of other alkali metals.

Water may be used in the formulation of detergent made in accordance with this invention. Water serves to hydrate, at least partially, the various other salts which are present and less than fully hydrated. It is desirable in at least some instances to use fully hydrated salts or a certain proportion of water, in order to avoid caking during storage of the final product. Water is not necessarily added per se—sometimes it is added, for example, in admixture with the nonionic surfactant. See, for example, U.S. Pat. No. 3,359,207. In order to obtain optimal shelf life, the procedure indicated in this patent should be followed. In some instances, the stability of the active chlorine-containing compound is promoted by the addition of water as indicated above. In general, the proportion of water to be used may range from 0 up to approximately 15 percent by weight.

Perhaps the most important component of the composition is the nonionic surfactant. In accordance with the invention, this ingredient is always used, to the extent of about 1 to 9 weight percent. The proportion of nonionic surfactant used will depend, of course, upon various factors, such as the amount and nature of the soil on the ware to be washed, the kind of machine used (short-cycle commercial machine vs. longer-cycle home machine), the wash-water temperature, etc. With less soil, more easily removable soil, a longer cycle, a higher wash-water temperature, or a higher proportion of detergent in the wash water, other things being equal, a lower proportion of nonionic surfactant in the composition will still yield satisfactory results, whereas higher proportions are required if the opposite conditions prevail. In general, satisfactory results are obtained with a detergent containing 2 to 6 weight percent of nonionic surfactant of the kind indicated above. Testing has not revealed any particular benefit which may be derived from the use of greater proportions of nonionic surfactant, such as 6 to 9 weight percent, nor has the testing shown any substantial detriment, apart from the consideration that compositions containing such greater proportions of nonionic surfactant of the kind indicated above are somewhat more costly to make and, as has been indicated, benefits which justify the added cost have not been observed. In making compositions of this kind, the identity and proportion(s) of the nonionic surfactant(s) used have a significant effect on the cost of the composition, because the nonionic surfactant is more costly, on a weight basis, than most of the other ingredients.

The possibility of mixing a nonionic surfactant of the kind indicated above with some other suitable nonionic surfactant is also not to be overlooked. Other suitable nonionic surfactants include the low-foaming oxypropylenecapped block polymers of U.S. Pat. No. 3,036,118, such as "Pluronic 25R2" surfactant. Although in some instances the use of such auxiliary nonionic surfactant may make it possible to obtain equivalent satisfactory results with the use of somewhat less of the amine-based nonionic surfactant of the kind indicated above, it will still be essential in most instances to have a dishwasher-detergent composition which contains 1 to 9 weight percent, preferably 2 to 6 weight percent, of an amine-based oxypropylene-capped nonionic surfactant of the kind indicated above.

There are, of course, other kinds of proteinaceous matter, such as beef or pork fat, which must also be totally and reliably removed, if the performance of the detergent is to be considered satisfactory. Particularly if the temperature of the washing liquid is to be kept on the low side, it can be difficult to obtain such total and reliable removal of other fats. It is necessary to work under low-foam conditions, since otherwise there is intolerable streaking and spotting. In order to obtain adequate performance against these other fats, especially at the lower working temperatures, it is particularly important not only to use a surfactant of the proper, effective, low-foaming and highly detergent type but also to use a quantity of it sufficient to deal with the loading of fatty soil present on the ware to be washed.

Although in prior-art dishwasher detergents it has been usual to use somewhat lower proportion of nonionic surfactant if the detergent is for home use rather than commercial use, I find that in the case of the present invention, it is preferable in either case to use approximately 3 to 6 percent of nonionic surfactant. Though home dishwashers employ a longer cycle and would appear to be capable of operating with less powerful detergent, there are the competing factors that they (1) are more often operated with water less hot than that used in commercial operations and (2) are more often required to wash dirty dishes which have sat for some time and become more difficult to clean.

In aqueous solution, a dishwasher detergent made as specified above exhibits a pH on the order of 9.0 to 10.5.

The invention discussed above is illustrated by the following specific examples. In the examples, parts or percentages are by weight unless otherwise specified.

EXAMPLE 1

There is made a dishwasher detergent which consists of 30 percent sodium citrate, 20 percent sodium carbonate, 4 percent chlorinated cyanurate, 30 percent sodium metasilicate pentahydrate, 5 percent of nonionic surfactant as hereinafter defined, and 11 percent of sodium sulfate as filler. The nonionic surfactant is of the formula

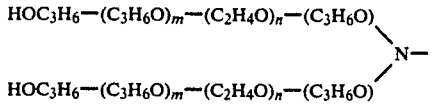

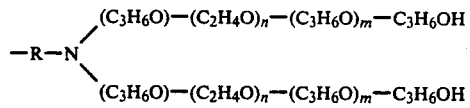

wherein n and m have values such that the molecular weight attributable to the oxypropylene units is about 1000 per chain and the portion of the molecular weight is attributable to the oxyethylene units is approximately 14 percent, and R is $—CH_2CH_2—$. Such detergent is used for machine dishwashing at the usual rate of 0.3 percent in the wash water, and with the wash-water temperature at 120° F. (49° C.), and satisfactory results are obtained, even when the dishes which are to be washed contain 27-minute-hardened egg soil.

EXAMPLE 2

Example 1 is repeated, except that n and m are such that the molecular weight attributable to oxyethylene units is about 15 percent and the molecular weight attributable to the oxypropylene hydrophobe is about 1775 per chain. The results are the same. Even with no phosphate present and the use of relatively low-temperature wash water, satisfactory results against long-hardened egg soil are obtained.

EXAMPLE 3

There is made a dishwasher detergent which consists of 30 percent sodium citrate, 20 percent sodium carbonate, 1.5 percent chlorinated cyanurate, 30 percent of sodium metasilicate pentahydrate, 6 percent of nonionic surfactant as hereinafter defined, and 12.5 percent of sodium sulfate as filler. The nonionic surfactant is of the formula:

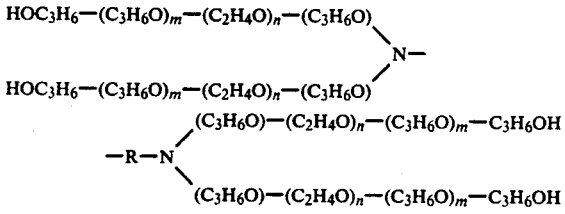

wherein n and m have values such that the molecular weight attributable to the oxypropylene units is about 1000 per chain, the molecule containing 4 such chains, and the portion of the molecular weight which is attributable to the oxyethylene units is approximately 14 percent, and R is $—CH_2CH_2—$. cl EXAMPLE 4

Example 1 is repeated, except that n and m are such that the molecular weight attributable to the oxypropylene hydrophobe is about 1775 per chain.

COMPARISON TEST A

Example 3 is repeated, except that the nonionic surfactant is of the formula:

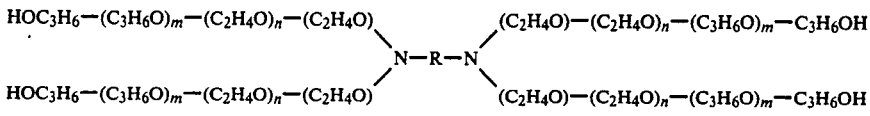

In other words, the nonionic surfactant is one which is made by first oxyethylating and then oxypropylating not N,N,N', N'-tetrakis(2-hydroxypropyl)ethylenediamine but N,N,N',N'-tetrakis(2-hydroxyethyl)ethylenediamine.

COMPARISON TEST B

Comparison Test A is repeated, except that n and m have values such that the molecular weight attributable to oxypropylene units is about 1775 per chain.

Comparison tests were conducted which reveal that detergents made in accordance with Examples 3 and 4, containing a nonionic surfactant based upon tetraoxypropylated ethylenediamine, substantially surpass in their performance in dishwashing tests to determine streaking properties and food-soil-removal properties the essentially similar detergents which are ones containing a nonionic surfactant based upon tetraoxyethylated ethylenediamine.

The data tabulated below result from tests which were conducted in a manner now to be explained.

In the Spotting-Streaking Test, there are placed into a dishwasher of the kind used in the home (Kitchen Aid Model KDS-56 or equivalent) five perfectly clean drinking glasses (approximately 6.3 centimeters in diameter and 13 centimeters high). The glasses used are ones that have been inspected under ultraviolet light and found perfectly free of spots, streaks, and film. They bear etched identification numbers. The initial positions of the glasses are noted, and to eliminate possible spray-pattern effects, the positions of the glasses are changed after the first and second of the three cycles comprising the test. In each cycle, the dishwasher is also charged with chinaware dinner plates, plastic dinner plates, knives, forks, and spoons—six of each.

In each cycle, the plastic dinner plates are provided with an artificial soil. For the first cycle, the soil comprises 25 grams of a composition made by melting and mixing at a maximum temperature of 39° C. a mixture of 4 parts by weight of oleomargarine and 1 part of powdered milk. For the second cycle, the soil comprises 25 grams of soil as used in the first cycle plus 12 grams of powdered milk. For the third cycle, the soil comprises 25 grams of soil as used in the first cycle plus 15 milliliters of stirred, raw whole egg.

The dishwasher is operated at a working temperature of 140° F. (60° C.), being permitted to run empty for a few cycles to insure that this operating temperature is attained. In each cycle, 20 grams of the dishwasher detergent to be tested is used.

After each cycle, the glasses are removed from the dishwasher and examined under ultraviolet light and graded in accordance with the following scale:

| | |
|---|---|
| E (excellent) | 1.0 to 1.2 |
| VG (very good) | 1.3 to 1.5 |
| G (good) | 1.6 to 1.8 |

-continued

| | |
|---|---|
| F (fair) | 1.9 to 2.1 |
| P (poor) | 2.2 or greater |

Decimal grades are given; the test reproducibility is quite good. The numerical grades may also be considered as ones resulting from the use of a scale in which the numbers have the meanings indicated below:

1—no spots or film
2—¼ spotted or filmed
3—½ spotted or filmed
4—¾ spotted or filmed
5—fully spotted or filmed In the Food Soil Removal Test, there are placed into a dishwasher as indicated above 15 perfectly clean glasses, 10 clean china dinner plates, and 6 soiled and 4 clean plastic dinner plates. For each cycle, the six soiled dinner plates are provided with a total of 40 grams of artificial soil, applied as evenly as possible.

The artificial soil used in the test is one based upon cooked breakfast cereal, powdered milk and oleomargarine. To be more precise, it is prepared by cooking 45 grams of Wheatena breakfast cereal and 228 grams of water at a boil for 5 minutes, then adding 600 grams of milk (prepared by mixing 100 grams of powdered milk and 500 grams of water) and stirring and permitting to cool to room temperature to produce a cooked-cereal ingredient, and then, in a separate vessel, melting 667 grams of oleomargarine and adding 166 grams of powdered milk and 167 grams of the above-mentioned cooked-cereal ingredient and mixing to form a uniform paste.

In the model of household dishwasher mentioned above, there are two dispenser cups into which detergent may be put, and the operation of the machine is such that the detergent in one of them is used at an earlier stage of one complete dishwashing cycle and the detergent in the other is used at a later stage. For each cycle, 20 grams of detergent to be tested are added to each of said cups, making 40 grams in all.

The performance of the detergent being tested is determined by an examination of the initially clean glasses, which are graded on a scale indicated below. (The initially soiled plates are, of course, inspected, and if any food soil remains on any of them, the detergent is declared a failure; in this test, the merit of a detergent is determined in accordance with its demonstrated ability to deal with the problem of ensuring ultimate removal from the glasses and other ware in the machine of the food soil which has been washed off the soiled plates.) The glasses are examined after 15 complete cycles and given decimal grades on the following scale:

| | |
|---|---|
| E (excellent) | 1.0 to 1.9 |
| VG (very good) | 2.0 to 2.9 |
| G (good) | 3.0 to 3.9 |
| F (fair) | 4.0 to 4.9 |
| P (poor) | 5.0 to 6.0 |

In the tests reported below, the compositions prepared in accordance with Examples 3 and 4 and Comparison Tests A and B were subjected to the Spotting-Streaking Test and the Food Soil Removal Test.

Spotting-Streaking Test

Ratings

-continued

| | Example 3 | Example 4 | Test A | Test B |
|---|---|---|---|---|
| First Cycle | 1.1 | 1.0 | 1.4 | 1.3 |
| Second Cycle | 1.2 | 1.1 | 1.8 | 1.5 |
| Third Cycle | 1.3 | 1.2 | 2.2 | 1.8 |
| Overall Rating | E | E | G | VG |

Food Soil Removal Test

Ratings

| | Example 3 | Example 4 | Test A | Test B |
|---|---|---|---|---|
| After 15 cycles | 1.9 | 1.8 | 4.1 | 3.3 |
| Overall Rating | E | E | F | G |

The foregoing results clearly demonstrate that careful attention must be paid to the exact chemical nature of the nonionic surfactant used in the dishwahser detergents of the invention, because substantially poorer results are observed with a very slight change in chemical structure of the nonionic-surfactant ingredient of the composition.

While I have shown and described herein certain embodiments of my invention, I intend to cover as well any change or modification therein which may be made without departing from its spirit and scope.

The embodiments of the invention in which an exclusive property or privilege is claimed are defined as follows:

1. A method of washing dishware comprising the step wherein said dishware is brought into contact with water and 0.2 to 0.5 percent by weight of a detergent at a temperature of 71° C. to 38° C., said detergent consisting essentially of 1 to 9 weight percent of a phosphate-free, nonionic surfactant of the structural formula:

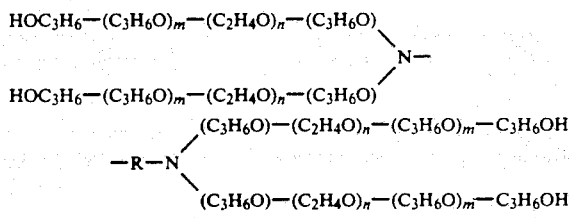

wherein n and m are such that the molecular weight attributable to the oxypropylene hydrophobe is 800 to 2000 per chain and the portion of the molecular weight attributable to oxyethylene units is 5 to 16 percent, R being a divalent organic radical containing 2 to 6 carbon atoms and 22 to 38 weight percent of sodium citrate, 15 to 25 percent by weight of sodium carbonate, 1 to 6 percent by weight of chlorinated cyanurate, and 20 to 40 percent by weight of sodium metasilicate.

2. The method of claim 1 wherein said detergent also contains 2 to 15 percent by weight of a filler selected from the group consisting of at least one of an alkali metal chloride or sulfate.

3. The method of claim 2 wherein R is alkylene of 2 to 6 carbon atoms.

4. The method of claim 3 wherein said filler is selected from the group consisting of at least one of sodium chloride and sodium sulfate.

5. The method of claim 4 wherein R is the ethylene radical.

6. A phosphate-free dishwasher detergent composition effective at a temperature of 71° C. to 38° C. consisting essentially of 1 to 9 percent by weight, based upon the total weight of said detergent composition of a nonionic surfactant, said surfactant having the structural formula:

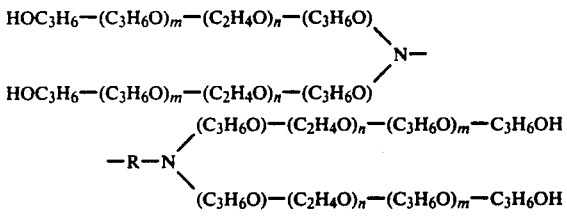

wherein n and m are such that the molecular weight attributable to the oxypropylene hydrophobe is 800 to 2000 per chain and the portion of the molecular weight attributable to oxyethylene units is 5 to 16 percent, R being a divalent organic radical containing 2 to 6 carbon atoms and 22 to 38 percent by weight of sodium citrate, 15 to 25 percent by weight of sodium carbonate, 1 to 6 percent by weight of chlorinated cyanurate, and 20 to 40 percent by weight of sodium metasilicate.

7. The composition of claim 6 wherein said composition also contains 2 to 15 percent by weight of a filler selected from the group consisting of at least one of an alkali metal chloride or sulfate.

8. The composition of claim 7 wherein R is alkylene of 2 to 6 carbon atoms.

9. The composition of claim 7 wherein said filler is selected from the group consisting of at least one of sodium chloride and sodium sulfate.

10. The composition of claim 9 wherein R is the ethylene radical.

11. A phosphate-free dishwasher detergent effective at a temperature of 71° C. to 38° C. consisting essentially of 1 to 9 percent by weight of a nonionic surfactant, based upon the total weight of said detergent, said surfactant consisting of a block polymer surfactant prepared by first oxyethylating and then oxypropylating N,N,N',N'-tetrakis-(2hydroxypropyl)-ethylenediamine, the oxyethylene units accounting for 5 to 16 percent of the molecular weight of said compound and the molecular weight attributable to the oxypropylene units being 800 to 2000 per chain and 22 to 38 percent by weight of sodium citrate, 15 to 25 percent by weight of sodium carbonate, 1 to 6 percent by weight of chlorinated cyanurate, and 20 to 40 percent by weight of sodium metasilicate.

12. The detergent of claim 11 wherein said detergent also contains 2 to 15 percent by weight of a filler selected from the group consisting of at least one of the alkali metal chlorides and sulfates.

13. The detergent of claim 12 wherein said filler is selected from the group consisting of at least one of sodium chloride and sodium sulfate.

* * * * *